United States Patent [19]

Momoki et al.

[11] Patent Number: 4,803,152

[45] Date of Patent: Feb. 7, 1989

[54] SILVER HALIDE PHOTOGRAPHIC MATERIAL CONTAINING NOVEL CHLORIDE CONTENT

[75] Inventors: Yasuhito Momoki; Kazunori Hasebe, both of Kanagawa, Japan

[73] Assignee: Fuji Photo Film Co., Ltd., Kanagawa, Japan

[21] Appl. No.: 58,712

[22] Filed: Jun. 5, 1987

[30] Foreign Application Priority Data

Jun. 5, 1986 [JP] Japan ..... 61-130739

[51] Int. Cl.[4] ..... G03C 1/02; G03C 7/23

[52] U.S. Cl. ..... 430/567; 430/505; 430/542; 430/543; 430/554; 430/555; 430/558; 430/569; 430/570

[58] Field of Search ..... 430/567, 569, 505, 542, 430/543, 570, 554, 555, 558

[56] References Cited

U.S. PATENT DOCUMENTS

| | | | |
|---|---|---|---|
| 3,935,014 | 1/1976 | Klötzer et al. | 430/567 |
| 3,957,488 | 5/1976 | Klötzer et al. | 430/567 |
| 4,301,242 | 11/1981 | Patzold et al. | 430/407 |
| 4,414,306 | 11/1983 | Wey et al. | 430/567 |
| 4,444,865 | 4/1984 | Silverman et al. | 430/567 |
| 4,507,386 | 3/1985 | Matsuzaka et al. | 430/567 |
| 4,554,245 | 11/1985 | Hayashi et al. | 430/567 |

FOREIGN PATENT DOCUMENTS

| | | | |
|---|---|---|---|
| 1215540 | 9/1986 | Japan | 430/567 |

*Primary Examiner*—Mukund J. Shah

*Attorney, Agent, or Firm*—Sughrue, Mion, Zinn, Macpeak & Seas

[57] ABSTRACT

A photogrphic light-sensitive material comparing a support having thereon at least one silver halide emulsion layer, wherein the silver halide emulsion layer comprises a silver chlorobromide emulsion which is substantially free of iodide and has a chloride content which satisfies the following relationship (I) between a mean mole % of silver chloride in grain group (A), in which the grains have sizes not less than the median size in the grain size distribution, and a mean mole % of silver chloride in grain group (B) in which the grains have sizes less than the median size, whereby excellent gradation and wide exposure latitude are achieved, and there is a small dependence on the development conditions.

Relationship (I): $1 \leqq$ [Mean mol % of silver chloride in grain group (A)] − [Mean mol % of silver chloride in grain group (B)] $\leqq 99$.

18 Claims, 1 Drawing Sheet

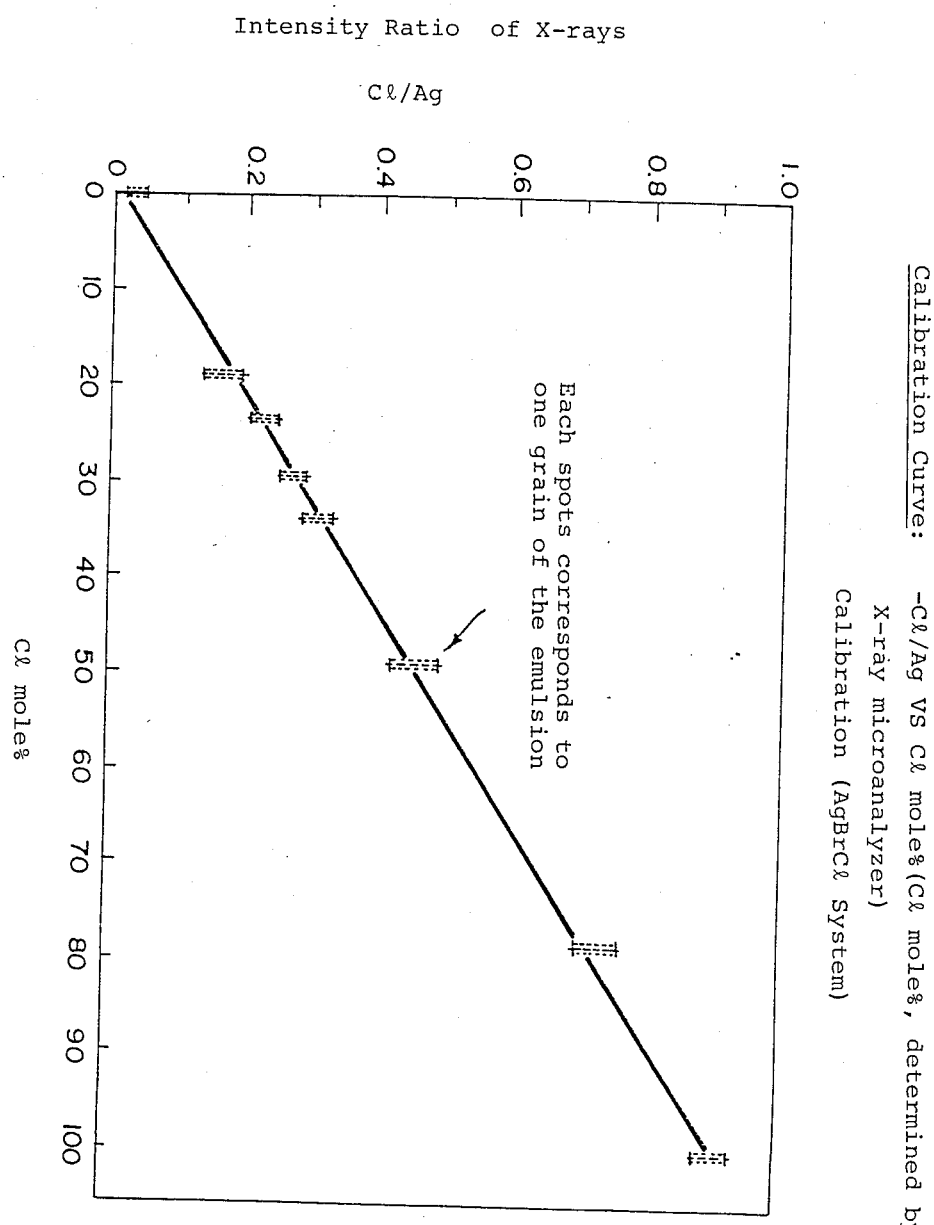
Calibration Curve:
-Cℓ/Ag VS Cℓ mole%(Cℓ mole%, determined by X-ray microanalyzer)
Calibration (AgBrCℓ System)
Intensity Ratio of X-rays
Cℓ/Ag
1.0
0.8
0.6
0.4
0.2
0
Each spots corresponds to one grain of the emulsion
0
10
20
30
40
50
60
70
80
90
100
Cℓ mole%

SILVER HALIDE PHOTOGRAPHIC MATERIAL CONTAINING NOVEL CHLORIDE CONTENT

FIELD OF THE INVENTION

The present invention relates to a silver halide photographic material and, more particularly, to a silver halide photographic material which has excellent gradation and wide exposure latitude, and shows a reduced dependency on the conditions of development.

BACKGROUND OF THE INVENTION

In most silver halide photographic materials, except those of lith film and the like, both excellent gradation and wide exposure latitude are required.

In general, the sensitivity of a silver halide emulsion is known to depend on the size of the grains contained in the emulsion. Accordingly, the exposure latitude of a silver halide photographic material depends largely on the grain size distribution of the silver halide grains contained therein, and it is well known that it is possible to widen the exposure latitude by broadening the grain size distribution.

However, the presence of a mixture of silver halide grains of different sizes in the same layer has a disadvantage in that such is responsible for variation of development processing characteristics. This is because there is a great difference in the developing speed between silver halide emulsion grains having a large size and those having a small size when the silver halide emulsion undergoes development processing.

In an integral multilayer color photosensitive material it is particularly important to maintain the balance of the developing speeds among the constituent layers. Thus, the use of an emulsion which has a broad grain size distribution is undesirable from the view point of designing the photosensitive material.

In order to overcome the disadvantage arising from differences in the grain size, desensitizers have been added to emulsions, as described in West German Pat. No. 2,708,466 (corresponding to U.S. Pat. No. 4,301,242). However, this method is undesirable because it is accompanied by a decrease in the efficiency of using the silver and a deterioration of the granularity of the developed image.

It is also known that wide exposure latitude and soft gradation can be achieved by coating a spectrally sensitized high-speed emulsion and a spectrally sensitized slow emulsion in separate layers. However, multilayer coating is undesirable because the production thereof is complicated.

Moreover, there are known variable contrast photosensitive materials of the kind which can change their gradation depending on the wavelength range of the exposure light by mixing silver halides having different spectral sensitivities. However, it is difficult to stably acquire soft gradation with respect to the exposure wavelength range.

SUMMARY OF THE INVENTION

Therefore an object of the present invention is to overcome the above described disadvantage, and to provide a silver halide photographic material which has excellent gradation and wide exposure latitude, and a reduced dependency on the conditions of development.

Another object of the present invention is to provide a silver halide photographic material in which the efficiency of using the silver is high, there is no deterioration of the granularity of the developed image, and the manufacturing thereof is uncomplicated.

The objects of the present invention has been met by a photographic light-sensitive material comprising a support having thereon at least one silver halide emulsion layer, wherein the silver halide emulsion layer comprises a silver chlorobromide emulsion which is substantially free of iodide and has a chloride content which satisfies the following relationship (I) between the mean mol% of silver chloride in grain group (A), in which the grains have sizes not smaller than the median size in the grain size distribution of said silver halide emulsion, and the mean mol% of silver chloride in grain groups (B) in which the grains have sizes smaller than the median size.

Relationship (I): $1 \leqq$ [Mean mol% of silver chloride in grain group (A)] − [Mean mol% of silver chloride in grain group (B)] $\leqq 99$

BRIEF DESCRIPTION OF DRAWING

The sole FIGURE of the drawing is a calibration curve of the silver chloride content for the intensity ratio of X-rays measured with an X-ray microanalyzer.

DETAILED DESCRIPTION OF THE INVENTION

In the relationship (I), the difference between the mean mol% of silver chloride in grain group (A) and that in grain group (B) (which is hereinafter called "D-value") is preferably within the range of 3 to 50, more preferably 5 to 30.

The term "median size" used herein describes the size of the grains which falls on the cumulative number corresponding to 50% of the total number when all of the silver halide emulsion grains are lined up in order of grain size and counted from one end. The term "grain size" used herein refers to the diameter of a circle of grain equal to the projected area of a grain.

A preferable mean grain size of the silver halide emulsion grains to be used in the present invention is within the range of 0.1 to 2 $\mu$m, particularly 0.2 to 1.3 $\mu$m.

The silver halide emulsion contained in the silver halide emulsion layer of the present invention may have either one peak or not less than two peaks in the grain size distribution.

In order to vary the bromide content in the silver halide emulsion grains, a method of mixing two or more kinds of silver halide emulsions differing in bromide content may be employed, or a method of adding silver salts or halides in the preparation of one kind of silver halide emulsion may be devised.

As for the method of determining the halogen composition distribution in silver halide emulsion grains, powder X-ray difractiometry as described, e.g., in Japanese patent application (OPI) No. 110926/81 (the term "OPI" as used herein means an "unexamined published application") has so far been employed. However, this method cannot differentiate the distribution of halogen compositions among grains from the halogen composition distribution inside each grain. Therefore, so long as the analysis of halogen compositions among silver halide emulsion grains is undertaken using the powder X-ray diffractometry alone, it is difficult to systematically draw a guide to design the emulsions, which are specified by the distribution of the halogen compositions among the silver halide emulsion grains, from the results of the analysis. Accordingly, halogen composition distributions of individual silver halide emulsion grains are determined herein using an X-ray microanalyzer as described below.

The silver chloride contents of the individual emulsion grains can be determined by analyzing the composition of each individual silver halide grain, e.g., with an X-ray microanalyzer.

Specifically, the determination of the silver chloride contents of the individual grains is carried out in the following manner. To begin with, a sample emulsion is diluted 5 times with distilled water and thereto, a proteolytic enzyme (e.g., actinase) is added and kept at 40° C. for 3 hours to degrade the gelatin. The resulting sample is centrifuged to settle the emulsion grains, and the supernatant is removed. Then, distilled water is added again to the residue, and the emulsion grains are redispersed into the distilled water. This washing procedure is repeated twice and then, the sample is spread over the sampling plate. After drying, carbon is vapor-deposited onto the spread sample, and measurement with an X-ray microanalyzer is conducted. All general models of X-ray microanalyzers on the market can be used herein, and a special apparatus is not required. The determination is effected by irradiating each individual grain with electron beams to excite the constituent elements in the grain and measuring the intensities of the characteristic X-rays emitted by the excited elements using a wavelength dispersive X-ray detector. Analyzing crystals and wavelengths of the characteristic X-rays used for the analyses of the individual elements are set forth in Table 1 below. In order to determine the silver chloride content in the desired grain from the intensities of the characteristic X-rays of the individual elements, a calibration curve as shown in the drawing is previously prepared by using grains having known silver chloride contents and submitting them to the same measurement as described above. From this calibration curve, the silver chloride content can be evaluated.

TABLE 1

| Element | Wavelength (analytical line) | Analizing Crystal |
|---|---|---|
| Ag | 4.154 Å (Ag—$L_{\alpha 1}$) | PET*1 |
| Br | 8.375 Å (Br—$L_{\alpha 1}$) | RAP*2 |
| Cl | 4.729 Å (Cl—$K_{\alpha 1,2}$) | PET*1 |

*1PET: Pentaerythritol
*2RAP: Rubidium Phthalate

The silver halide emulsion used in the present invention is silver chlorobromide which is substantially free of iodide.

The expression "substantially free of iodide" signifies an iodide content of 1 mol% or less, preferably 0.5 mol% or less, and particularly preferably zero mol%. The presence of silver iodide in emulsion grains is undesirable because it causes a decrease in the developing speed and, in a case where the grain has a fogging nucleus, an increase in fog is caused.

The present invention is not particularly restricted as to the contents of silver chloride and silver bromide. The contents can be arbitrarily chosen, from pure silver chloride to pure silver bromide, provided that they are within the restricted condition regarding the composition distribution of the present invention.

The interior and the surface of the silver halide grains which can be employed in the invention may differ, i.e., the silver halide grains may have a multiphase structure so as to have conjunct faces, or the silver halide grains may be uniform throughout. The silver halide grains of the above-described kinds may be present as a mixture.

The silver halide grains to be employed in the present invention may have a regular crystal form, such as that of a cube, an octahedron, a dodecahedron or a tetradecahedron, or an irregular crystal form, such as that of a sphere or so on. The crystal form of the grain is preferably a cube or a tetradecahedron in the present invention. Also, the grains may have a composite form of these crystal forms. Moreover, the grains may have a tabular form in which the grain diameter is greater than the grain thickness by a factor of 5 or more, particularly 8 or more. Emulsions which contain such tabular grains as described above in a fraction of 50% or more based on the total projection area of all the grains present therein may be employed in this invention. Emulsions which contain silver halide grains having various kinds of crystal forms as a mixture may be employed. These various kinds of emulsions may be either those which form latent images predominantly at the surface of the grains, or those which mainly form latent images inside the grains.

These photographic emulsions can be prepared using various methods as described, e.g., in P. Grafkides, *Chimie et Physique Photographique,* Paul Montel, Paris (1967), G. F. Duffin, *Photographic Emulsion Chemistry,* The Focal Press, London (1966), V. L. Zelikman, et al, *Making and Coating Photographic Emulsion,* The Focal Press, London (1966) and so on. More specifically, any process, e.g., the acid process, the neutral process, the ammoniacal process and so on, can be employed.

Suitable methods for reacting a water-soluble silver salt with a water-soluble halide include, e.g., a single jet method, a double jet method or a combination thereof.

Also, a method in which silver halide grains are produced in the presence of excess silver ion (the so-called reverse mixing method) can be employed. Moreover, the so-called controlled double jet method, in which the pAg of the liquid phase in which the silver halide grains are to be precipitated is maintained constant, may be employed. According to this method, silver halide emulsions having a regular crystal form and an almost uniform grain size can be obtained.

The silver halide emulsions which can be used in the present invention is preferably a monodispersed emulsion. A variation coefficient (which is determined as the value obtained by dividing the standard deviation of the grain size distribution (S) by the mean grain size ($\gamma$):($S/\gamma$) of the monodispersed emulsion according to the present invention is not more than 0.20, preferably not more than 0.15, more preferably not more than 0.10.

Furthermore, emulsions prepared according to a so-called conversion process, which comprises a step of converting already prepared silver halde to silver halide having a lower solubility product by the conclusion of the formation of silver halide grains, and emulsions which have undergone the same silver halide conversion as described above after the conclusion of the silver halide grain formation can be employed.

In a process of producing silver halide grains or allowing the produced silver halide grains to ripen physically, cadmium salts, zinc salts, lead salts, thallium salts, iridium salts or complexes, rhodium salts or complexes, iron salts or complexes and/or the like may be present.

In preparing the photographic emulsion of the present invention, known silver halide solvents can be used. Frequently used silver halide solvents include ammonia, thioethers, thioureas, thiocyanates, thiazolinethiones, and so on. For details of thioethers, U.S. Pat. Nos. 3,271,157, 3,574,628 and 3,790,387, and so on can be referred to. For details of thioureas Japanese patent application (OPI) Nos. 82408/78 and 77737/80, for those of thiocyanates U.S. Pat. Nos. 2,222,264, 2,448,534 and 3,320,069, and for those of thiazolinethiones Japanese patent application (OPI) No. 144319/78 can be referred to.

The silver halide grains of the present invention can be chemically sensitized, if needed.

Specifically, a sulfur sensitization method which used active gelatin or a compound containing sulfur capable of reacting with silver ions (e.g., thiosulfates, thioureas, mercapto compounds, rhodamines, etc.), a reduction sensitization method which uses a reducing material (e.g., stannous salts, amines, hydrazine derivatives, formamidinesulfinic acid, silane compounds, etc.) and a noble metal sensitization method which uses a metal compound (e.g., gold complex salts, complex salts of Group VIII metals such as Pt, Ir, Pd, etc.) can be employed individually or as a combination thereof.

Examples of the sulfur sensitization method are described in U.S. Pat. Nos. 1,574,944, 2,278,947, 2,410,689, 2,728,688 and 3,656,955, and so on, those of the reduction sensitization method are described in U.S. Pat. Nos. 2,419,974, 2,983,609 and 4,054,458, and so on, and those of the noble metal sensitization method are described in U.S. Pat. Nos. 2,399,083 and 2,448,060, British Pat. No. 618,061, and so on.

It is preferred that the silver halide grains of the present invention be subjected to gold sensitization, sulfur sensitization or the combination thereof, particularly from the standpoint of saving silver.

The silver halide grains of the present invention can be spectrally sensitized with known methine dyes such as cyanine dyes, merocyanine dyes, etc., or other dyes, if desired.

These sensitizing dyes may be used in any step during the emulsion-making process. Specifically, they may be used (1) during the formation of the silver halide grains, (2) during the physical ripening, or at the stage after physical ripening to before chemical sensitization, or (3) during the chemical sensitization, or at the stage after chemical sensitization to before coating. In particular, they are used to advantage in the foregoing step (2).

Various kinds of color couplers can be used in the present invention.

Useful couplers are those capable of forming cyan, magenta and yellow colors, respectively.

Typical examples of those couplers include naphthol or phenol compounds, pyrazolone or pyrazoloazole compounds, and open-chain or heterocyclic ketomethylene compounds. Specific examples of such cyan, magenta and yellow couplers which can be used in the present invention are described in the patents cited in *Research Disclosure* (abbreviated as RD, hereinafter) 17643, Section VII-D (December 1978) and ibid. 18717 (November 1979).

It is preferred that color couplers which are to be incorporated in the sensitive material should be rendered nondiffusible as a result of containing a ballast group or being in a polymerized form. Moreover, two-equivalent color couplers which have a coupling removable group at the coupling active site are preferred to four-equivalent ones having a hydrogen atom at that site because the coverage of silver can be reduced. Couplers which can be converted to dyes having a moderate diffusibility as a result of color development, colorless couplers, DIR couplers which can release development inhibitors in proportion as the coupling reaction proceeds, and couplers capable of releasing development accelerators upon the coupling reaction can also be employed.

As representative examples of the yellow couplers which can be used in the present invention, mention may be made of oil-protected acylacetoamide couplers. Specific examples of such couplers are described in U.S. Pat. Nos. 2,407,210, 2,875,057 and 3,265,506, and so on. In the present invention, two-equivalent yellow couplers are preferably employed, and typical representatives are yellow couplers of the type which are to be split off at the oxygen site, as described, e.g., in U.S. Pat. Nos. 3,408,194, 3,447,928, 3,933,501 and 4,022,620, and yellow couplers of the type which are to be split off at the nitrogen site, as described, e.g., in Japanese patent publication No. 10739/83, U.S. Pat. Nos. 4,401,752 and 4,326,024, RD 18053 (April 1979), British Pat. No. 1,425,020, West German patent application (OLS) Nos. 2,219,917, 2,261,361, 2,329,587 and 2,433,812. Of these yellow couplers, α-pivaloylacetoanilide couplers are of great advantage in that they can produce dyes excellent in fastness, especially to light, and α-benzoylacetonilide couplers are of advantage in that they can ensure high color density to developed images.

Cyan couplers which can be used in the present invention include couplers of oil-protected naphthol and phenol types. Representative examples of such couplers are the naphthol couplers described in U.S. Pat. No. 2,474,293, and more preferably two-equivalent naphthol couplers of the type which are to be split off at the oxygen site, as described in U.S. Pat. Nos. 4,052,212, 4,146,396, 4,228,233 and 4,296,200. On the other hand, specific examples of phenol type cyan couplers are described in U.S. Pat. Nos. 2,369,929, 2,801,171, 2,772,162 and 2,895,826, and so on. Cyan couplers fast to moisture and temperature are preferably used in the present invention, and typical examples thereof include phenol type cyan couplers which have an alkyl group containing 2 or more carbon atoms at the metha-position of the phenol nucleus, as described in U.S. Pat. No. 3,772,002, couplers of 2,5-di-acylamino-substited phenol type, as described in U.S. Pat. Nos. 2,772,162, 3,758,308, 4,126,396, 4,334,011 and 4,327,173, West German patent application (OLS) No. 3,329,729, European Pat. No. 121,365, and so on, and phenol couplers having a phenylureido group at the 2-position and an acylamino group at the 5-position, as described in U.S. Pat. Nos. 3,446,622, 4,333,999, 4,451,559 and 4,427,767, and so on. In addition, cyan couplers described in Japanese patent application (OPI) Nos. 237448/85, 153640/86 and 145557/86, which have a sulfonamido group, an amido group or the like at the 5-position of their respective naphthol nuclei, can be used to advantage in the present invention because they can produce image dyes excellent in fastness.

Magenta couplers which can be employed in the present invention include those of the oil-protected indazolone or cyanoacetyl type, and preferably those of the pyrazoloazole type, such as 5-pyrazolones, pyrazolotriazoles and the like. Of 5-pyrazolone couplers, those having an arylamino group or an acylamino group at the 3-position are preferred over others from the standpoint of superior hue and color density of the developed dyes, and specific examples thereof are described in U.S. Pat. Nos. 2,311,082, 2,343,703, 2,600,788, 2,908,573, 3,062,655, 3,152,896 and 3,936,015, and so on.

As for the splitting-off groups of the two-equivalent 5-pyrazolone couplers, groups which can split off at the nitrogen site, as described in U.S. Pat. No. 4,310,619, and arylthio groups described in U.S. Pat. No. 4,351,897 are particularly preferable. Also, ballast group-containing 5-pyrazolone couplers described in European Pat. No. 73,636 can provide high color density of the developed images.

Specific examples of magenta couplers of the pyrazoloazole type include pyrazolobenzimidazoles described in U.S. Pat. No. 3,061,432 and, preferably, pyrazolo[5,1-c]-[1,2,4]triazoles described in U.S. Pat. No. 3,725,067, pyrazolotetrazoles described in RD No. 24220 (June, 1984), and pyrazolopyrazoles described in RD No. 24230 (June, 1984). From the viewpoints of smallness of yellow side-absorption and excellence of light fastness of the developed dyes, imidazo[1,2-b]pyrazoles described in European Pat. No. 119,741 are preferred, and pyrazolo[1,5-b][1,2,4]triazoles described in European Pat. No. 119,860 are particularly preferable.

Couplers which can produce dyes having moderate diffusibility can be used together with the above-described couplers. Specific examples of magenta couplers of the above-described kind are described in U.S. Pat. No. 4,366,237 and British Pat. No. 2,125,570, while in European Pat. No. 96,570 and West German patent application (OLS) No. 3,234,533 are described those of yellow, magenta and cyan couplers of the foregoing kind.

Dye forming couplers and the above-described special couplers, other than those capable of forming diffusible dyes, may take a polymerized form (including a dimerized form). Typical examples of polymerized couplers are described in U.S. Pat. Nos. 3,451,820 and 4,080,211. Further, specific examples of polymerized magenta couplers are described in British Pat. No. 2,102,173 and U.S. Pat. No. 4,367,282.

Two or more of various kinds of couplers which can be employed in the present invention can be incorporated in the same light-sensitive layer, or the same coupler can be incorporated in two or more different layers, depending on the characteristics required of the sensitive material to be produced.

A standard amount of color coupler used ranges from 0.001 to 1 mole per mole of light-sensitive silver halide. A preferred amount of yellow coupler used ranges from 0.01 to 0.5 mole, that of magenta coupler from 0.003 to 0.3 mole, and that of cyan coupler from 0.002 to 0.3 mole. P A wide variety of compounds can be incorporated into the photographic emulsions to be employed in the present invention for the purposes of preventing fog or stabilizing photographic functions during production, storage or photographic processing of the sensitive material. Specific examples of such compounds include azoles (e.g., benzothiazolium salts, benzimidazolium salts, imidazoles, benzimidazoles (preferably 5-nitrobenzimidazoles), nitroindazoles, benzotriazoles (preferably 5-methylbenzotriazoles), triazoles, etc.); mercapto compounds (e.g., mercaptothiazoles, mercaptobenzothiazoles, mercaptobenzimidazoles, mercaptobenzoxazoles, mercaptoxadiazoles, mercaptothiadiazoles (especially 2-amino-5-mercapto-1,3,4-thiadiazoles, etc.), mercaptotriazoles, mercaptotetrazoles (especially 1-phenyl-5-mercaptotetrazole, etc.), mercaptopyrimidines, mercaptotriazines, etc.); thiocarbonyl compounds like oxazolinethione; azaindenes (e.g., triazaindenes, tetraazaindenes (especially 4-hydroxy-6-methyl-1,3,3a,7)-tetraazaindenes), pentaazaindenes, etc.); benzenethiosulfonic acids, benzenesulfinic acid, and bezenesulfonic acid amides; and compounds which have been known as antifoggants or stabilizers, such as purines like adenine, and so on.

Detailed examples of antifoggants or stabilizers and the ways of using them are described, for example, in U.S. Pat. Nos. 3,954,474 and 3,982,947, Japanese patent publication No. 28660/77, RD 17643 VIA-VIM (December, 1978), and E. J. Birr *Stabilization of Photographic Silver Halide Emulsion,* Focal Press (1974).

The present invention can also be applied to a multilayer muticolor photographic material comparing emulsions having at least two different spectral sensitivities provided on a support. An integral multilayer color photographic material has, in general, at least one red-sensitive emulsion layer, at least one green-sensitive emulsion layer and at least one blue-sensitive emulsion layer on a support. The order of these layers can be varied as desired. Each of the above-described emulsion layers may have two or more constituent layers differing in photographic speed and a light-insensitive layer may be arranged between any two of the constituent layers having the same spectral sensitivity.

In addition to the above-described silver halide emulsion layers, it is desired to provide proper auxiliary layers, such as a protective layer, an interlayer, a filter layer, an antihalation layer, a backing layer and so on, in the sensitive material produced in accordance with the present invention.

In the photographic light-sensitive material of the present invention, photographic emulsion layers and other layers are coated on a conventionally used flexible support, such as a plastic film, paper, cloth or the like, or a rigid support such as glass, ceramics, metals or so on. Of these supports, baryta paper and paper laminated with polyethylene in which a white pigment (e.g., titanium oxide) is contained are preferred over others as a support to be used in the present invention.

The present invention can be applied to various kinds of black-and-white, or color photographic materials. Representative examples of photograhic materials to which the present invention can be applied are black and white films for graphic arts, medical films, color negative films for amateur use or motion picture use, color reversal films for slide use or television use, color paper, color positive films, and color reversal paper. Of these photographic materials, the present invention can produce particularly good results when applied to color paper and color positive films. Further, the present invention can be applied to a black and white photographic material which utilizes the process of mixing three color couplers, as described in *Research Disclosure,* 17123 (July, 1978), and so on.

The color developing solution to be used for development processing of the photographic material of the present invention is an alkaline aqueous solution containing preferably an aromatic primary amine type color developing agent as a main component. Preferred developing agents of such a type are p-phenylenediamine compounds. Representative examples of p-phenylenediamine type developing agents are 3-methyl-4-aminoN,N-diethyaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and sulfates, hydrochloride or p-toluenesulfonates of the above-cited anilines.

After exposure, and color development subsequent thereto, the photographic material of the present invention is subjected to a bleach processing, and a fixation processing. These processings may be carried out simultaneously.

Suitable bleaching agents which can be used are complex salts formed, e.g., by Fe(III) or Co(III) and organic acids, such as aminopolycarboxylic acids, with specific examples including ethylenediaminetetraacetic acid, diethylenetriaminepentaacetic acid, nitrilotriacetic acid, 1,3-diamino-2-propanol tetraacetic acid, etc., citric acid, tartaric acid, malic acid and so on. Of these bleaching agents, ethylenediaminetetraacetatoferrate(III) complex salts and ethylenetriaminepentaacetatoferrate(III) complex salts are particularly useful in a combined bleaching and fixing bath.

As suitable fixing agents, thiosulfates, thiocyanates, thioether compounds, thioureas, and iodides can be employed, but thiosulfates are preferred.

After bleach-fixation processing or fixation processing, a washing processing is generally carried out.

The washing step is, in general, carried out using two or more tanks according to the countercurrent washing method for the purpose of saving water. On the other hand, a multistage countercurrent stabilization-processing step as described in Japanese patent application (OPI) No. 8543/82 may be carried out in place of the washing step.

A color developing agent may be incorporated in the photographic material for the purpose of simplifying and quickening the photographic processing. In this case, it is preferred that the color developing agent is used in the form of a precursor.

Further, various 1-phenyl-3-pyrazolidones may optionally be incorporated in the photographic material for the purpose of accelerating the color development.

The present invention is illustrated in greater detail by reference to the following examples. However, the invention should not be construed as being limited to these examples. Unless otherwise indicated, all parts, percents, ratios and the like are by weight.

EXAMPLE 1

On a paper support laminated with polyethylene on both sides, were coated the layers described in Table 2 to prepare an integral multilayer color photographic paper. The coating compositions used were prepared in the following manners, respectively.

Preparation of Coating Composition for First Layer 19.1 g of yellow coupler (a) and 4.4 g of color image stabilizer (b) were admixed with and dissolved into 27.2 ml of ethyl acetate and 7.9 ml of solvent (c). The resulting solution was emulsified and dispersed using 185 ml of a 10% (w/v) aqueous gelatin solution in which 8 ml of a 10% (w/v) aqueous solution of sodium dodecylbenzenesulfonate was contained. Separately, 90 g of a blue-sensitive emulsion was prepared by adding a blue-sensitive sensitizing dye having the structural formula illustrated below to a silver chlorobromide emulsion (bromide content: 80 mole%, Ag content: 70 g/Kg) in an amount of $7.0\times10^{-4}$ mole per mole of silver chlorobromide. The emulsified dispersion and the emulsion were mixed with and dissolved in each other, and the gelatin concentration in the emulsion was controlled so that the layer has the coposition described in Table-2 to prepare the coating composition for the first layer.

Coating compositions for the second to the seventh layers were prepared in the same manner as that for the first layer. In each layer, sodium salt of 1-oxy-3,5-dichloro-s-triazine was used as gelatin hardener.

Spectral sensitizing agent used in the individual emulsions are illustrated below.

Blue-sensitive emulsion Layer:

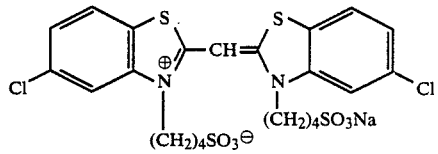

(added in an amount of $7.0\times10^{-4}$ mole per mole of silver halide)

Green-sensitive Emulsion Layer:

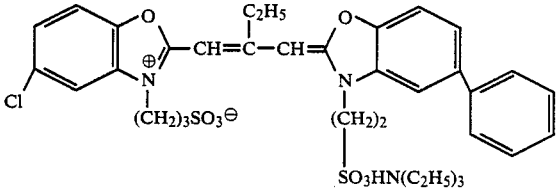

(added in an amount of $4.0\times10^{-4}$ mole per mole of silver halide)

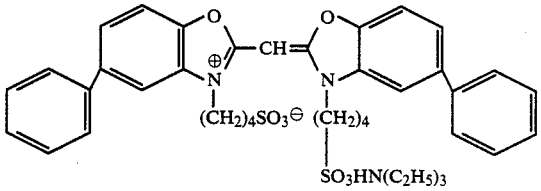

(added in an amount of $7.0\times10^{-5}$ mole per mole of silver halide)

Red-sensitive Emulsion Layer:

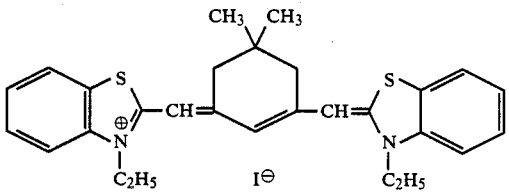

(added in an amount of $1.0\times10^{-4}$ mole per mole of silver halide)

Further, the following dyes were used as irradiation preventing dyes in their respective layers.

Green-sensitive Emulsion Layer:

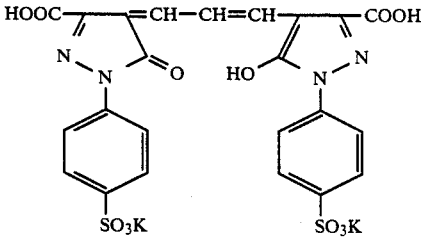

Red-sensitive Emulsion Layer:

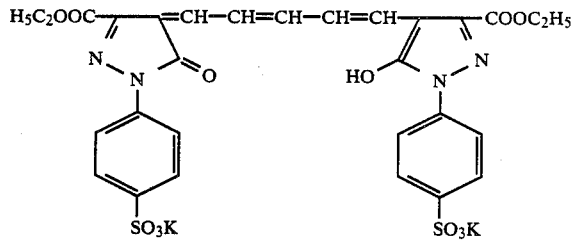
Structural formulae of the compounds, e.g., the couplers, used in this example are illustrated below.
(a) Yellow coupler
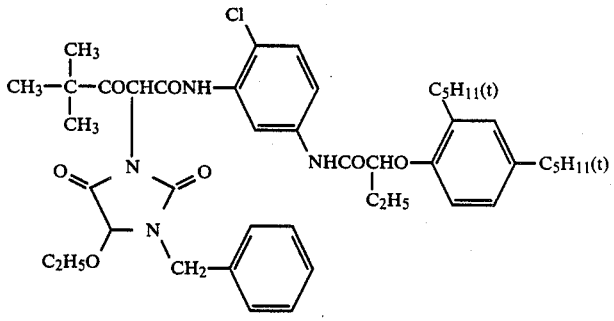
(b) Color Image Stabilizer
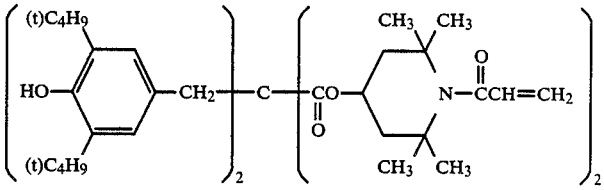
(c) Solvent
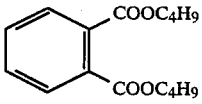
(d) Color Stain Inhibitor
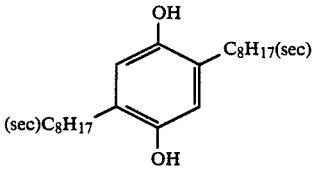
(e) Magenta Coupler
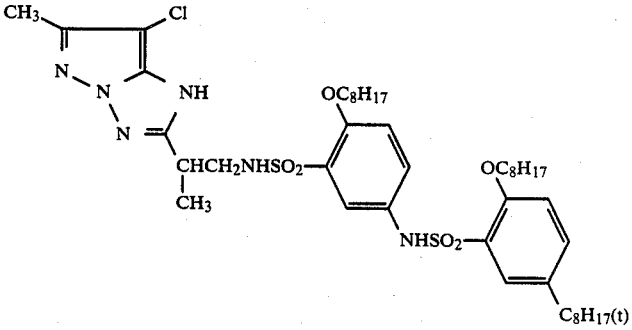
(f) Color Image Stabilizer
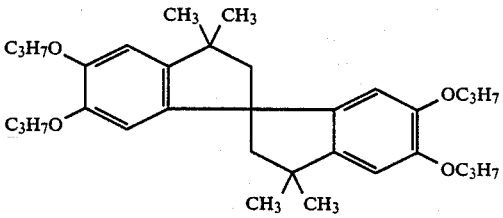

-continued
(g) Solvent
2:1 (by weight) Mixture of $(C_8H_{17}O)_3-P=O$ and
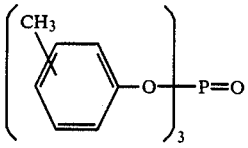
(h) Ultraviolet absorbent
1:5:3 (by mole) Mixture of
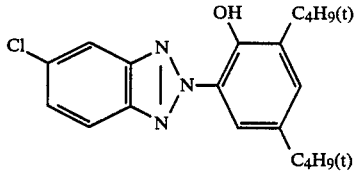
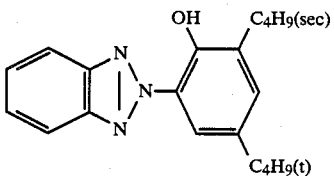
and
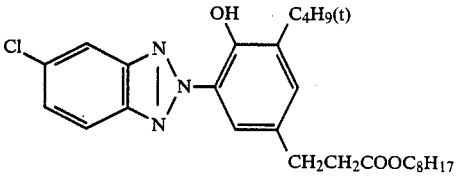
(i) Color Stain Inhibitor
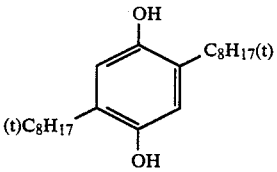
(j) Solvent
$(iso\text{-}C_9H_{19}O)_3-P=O$
(k) Cyan Coupler
1:1 (by mole) Mixture of
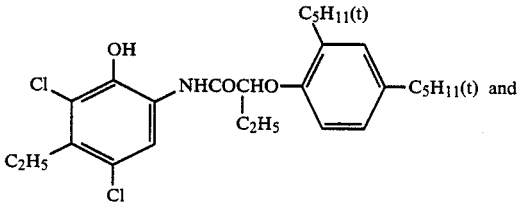
and
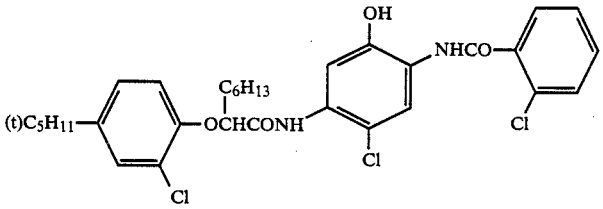
(l) Color Image Stabilizer
1:3:3 (by mole) Mixture of
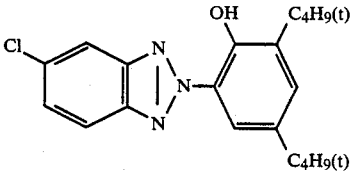
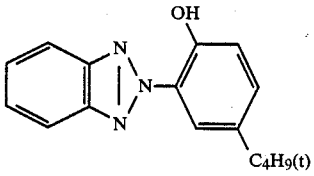
and
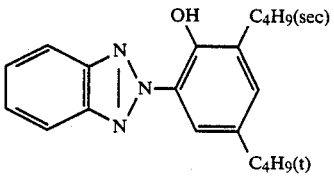

-continued (m) Solvent

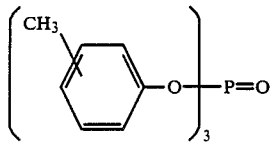

TABLE 2

| Layer | Main Ingredients | Amount Used |
|---|---|---|
| 7th Layer (Protective layer) | Gelatin | 1.33 g/m$^2$ |
| | Acryl-denatured polyvinyl alcohol (denaturing degree: 17%) | 0.17 g/m$^2$ |
| 6th Layer (Ultraviolet absorbing layer) | Gelatin | 0.54 g/m$^2$ |
| | Ultraviolet absorbent (h) | 0.21 g/m$^2$ |
| | Solvent (j) | 0.09 ml/m$^2$ |
| 5th Layer (Red-sensitive emulsion layer) | Silver chlorobromide emulsion (Bromide content: 70 mol) silver: | 0.26 g/m$^2$ |
| | Gelatin | 0.96 g/m$^2$ |
| | Cyan coupler (k) | 0.38 g/m$^2$ |
| | Color image stabilizer (l) | 0.17 g/m$^2$ |
| | Solvent (m) | 0.23 ml/m$^2$ |
| 4th Layer (Ultraviolet absorbing layer) | Gelatin | 1.60 g/m$^2$ |
| | Ultraviolet absorbent (h) | 0.62 g/m$^2$ |
| | Color stain inhibitor (i) | 0.05 g/m$^2$ |
| | Solvent (j) | 0.26 ml/m$^2$ |
| 3rd Layer (Green-sensitive emulsion layer) | Silver chlorobromide emulsion (Bromide content: 80 mol %) silver: | 0.16 g/m$^2$ |
| | Gelatin | 1.80 g/m$^2$ |
| | Magenta coupler (e) | 0.34 g/m$^2$ |
| | Color image stabilizer (f) | 0.20 g/m$^2$ |
| | Solvent (g) | 0.68 ml/m$^2$ |
| 2nd Layer (Color stain inhibiting layer) | Gelatin | 0.99 g/m$^2$ |
| | Color satin inhibitor (d) | 0.08 g/m$^2$ |
| 1st Layer (Blue-sensitive emulsion layer) | Silver chlorobromide emulsion (Bromide content: 80 mol %) silver: | 0.30 g/m$^2$ |
| | Gelatin | 1.86 g/m$^2$ |
| | Yellow coupler (a) | 0.82 g/m$^2$ |
| | Color image stabilizer (b) | 0.19 g/m$^2$ |
| | Solvent (c) | 0.34 ml/m$^2$ |
| Support | Polyethylene-laminated paper (containing white pigment ($TiO_2$) and bluish pigment (ultramarine) in polyethylene laminate on the 1st layer side) | |

Silver halide emulsions (1) to (8) which constituted the blue-sensitive emulsion layers employed in thie example were prepared in the following manners.

| | |
|---|---|
| Solution (a) | |
| Water | 1,000 ml |
| NaCl | 17.5 g |
| Gelatin | 25.0 g |
| Solution (b) | |
| Sulfuric Acid (1N) | 20.0 ml |
| Solution (c) | |
| Silver Halide Solvent represented by the following formula (1% qa. soln.) | 3.0 ml |

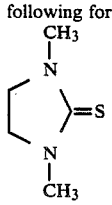

| | |
|---|---|
| Solution (d) | |
| KBr | 10.5 g |
| NaCl | 3.4 g |
| Water to make | 130 ml |
| Solution (e) | |

-continued

| | |
|---|---|
| $AgNO_3$ | 25.0 g |
| Water to make | 130 ml |
| Solution (f) | |
| KBr | 59.5 g |
| NaCl | 5.2 g |
| $K_2IrCl_6$ (0.01%) | 1.0 ml |
| Water to make | 340 ml |
| Solution (g) | |
| $AgNO_3$ | 100.0 g |
| Water to make | 340 ml |

Solution (a) was heated to 65° C., and thereto were added solution (b) and solution (c). Then, solution (d) and solution (e) were added simultaneously with vigorous stirring over a period of 20 minutes. After a ten-minute lapse, solution (f) and solution (g) were further added simultaneously over a period of 25 minutes. After a five-minute lapse from the conclusion of the simultaneous addition, the temperature of the reaction system was lowered, and desalting was carried out using a flocculation method. Water and gelatin were further added to the reaction product, and the temperature of the resulting dispersion was raised to 58° C., and the pH thereof was adjusted to 6.2. Thus, the monodispersed cubic silver chlorobromide emulsion (1) having a mean grain size of 1.0 μm, a variation coefficient (which was defined as the value obtained by dividing the standard deviation of the grain size distribution (S) by the mean grain size (γ), (S/γ) of 0.08, and a bromide content of 80 mole% was prepared.

This emulsion was subjected to optimal chemical sensitization by adding sodium thiosulfate thereto.

In the same manner as described above, except for changing the amounts of the ingredients used and the preparation temperature to those set forth in Table 3, monodispersed cibuc silver chlorobromide emulsions (2) and (3) which had the mean grain size of 1.0 μm, the variation coefficient of 0.08, and different bromide contents, that is, 77 mole% and 75 mole% respectively, and other monodispersed cubic silver chlorobromide emulsions (4), (5) and (6) which had the mean grain size of 0.8 μm, the variation coefficient of 0.07, and different bromide contents, that is, 80 mole%, 83 mole% and 85 mole% respectively were prepared.

TABLE 3

| Emulsion | Composition of Solution (d) Kbr (g) | NaCl (g) | Preparation Temperature (°C.) |
|---|---|---|---|
| (1) | 10.5 | 3.4 | 65 |
| (2) | 7.9 | 4.7 | 61 |
| (3) | 6.1 | 5.6 | 58 |
| (4) | 10.5 | 3.4 | 55 |
| (5) | 13.1 | 2.2 | 58 |
| (6) | 14.9 | 1.3 | 61 |

In the same manner as described above for preparing emulsion (1), except for changing the quantity of NaCl in solution (a) to 26.3 g and taking 15 minutes to fulfill the simultaneous addition of solution (d) and (e), emulsion (7), which had a mean grain size of 0.9 μm, a variation coefficient of 0.15 and a bromide content of 80 mole%, was prepared.

In addition, emulsion (8) was prepared in the following manner.

| | |
|---|---|
| Solution (h) | |
| Water | 1,000 ml |
| NaCl | 17.5 g |
| Gelatin | 25.0 g |
| Solution (i) | |
| Sulfuric Acid (1N) | 20.0 ml |
| Solution (j) | |
| Silver Halide Solvent represented by the following formula (1% aq. soln.) | 3.0 ml |

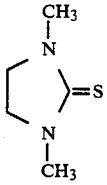

| | |
|---|---|
| Solution (k) | |
| KBr | 3.1 g |
| NaCl | 2.8 g |
| Water to make | 130 ml |
| Solution (l) | |
| $AgNO_3$ | 12.5 g |
| Water to make | 130 ml |
| Solution (m) | |
| NaCl | 5.8 g |
| KBr | 66.9 g |
| $K_2IrCl_6$ (0.001%) | 1.0 ml |
| Water to make | 340 ml |
| Solution (n) | |
| $AgNO_3$ | 112.5 g |
| Water to make | 340 ml |

Solution (h) was heated to 75° C., and thereto were added solution (i) and solution (j). Then, solution (k) and solution (l) were added simultaneously with vigorous stirring over a period of 10 minutes. After a ten-minute lapse, the temperature of the reaction mixture was lowered to 71° C., and 17% of solution (m) and solution (n) were added simultaneously for 30 seconds, and the remaining 83% of these solutions were added simultaneously over a period of 12 minutes. After a five-minute lapse from the conclusion of the simultaneous addition, the temperature of the reaction system was lowered, and desalting was carried out using a flocculation method. Water and gelatin were further added to the reaction product, and the temperature of the resulting dispersion was raised to 58° C., and the pH thereof was adjusted to 6.2. Thus, monodispersed cubic silver chlorobromide emulsion (8) having a mean grain size of 0.9 μm, a variation coefficient of 0.17, and a bromide content of 80 mole% was prepared. Emulsion (8) was examined for the D-value defined by the relationship (I) of the present invention through measurements in accordance with the method described hereinbefore. The D-value of emulsion (8) was 9.5.

On the other hand, the D-values of emulsions (1) to (7) were less than 1.0.

Silver halide emulsions (9) to (24) which constitute the green-sensitive emulsion layer and the red-sensitive emulsion layer employed in this example were prepared in the following manner.

| | |
|---|---|
| Solution (o) | |
| Water | 1,000 ml |
| NaCl | 5.5 g |
| Gelatin | 25 g |
| Solution (p) | |
| Sulfuric Acid (1N) | 20 ml |
| Solution (q) | |
| Silver Halide Solvent represented by the following formula (1% aq. soln.) | 2 ml |

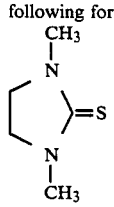

| | |
|---|---|
| Solution (r) | |
| KBr | 14.00 g |
| NaCl | 1.72 g |
| Water to make | 140 ml |
| Solution (s) | |
| $AgNO_3$ | 25 g |
| Water to make | 140 ml |
| Solution (t) | |
| KBr | 56.00 g |
| NaCl | 6.90 g |
| $K_2IrCl_6$ (0.001%) | 0.7 ml |
| Water to make | 320 ml |
| Solution (u) | |
| $AgNO_3$ | 100 g |
| Water to make | 320 ml |

Solution (o) was heated to 74° C., and thereto were added solution (p) and solution (g). Then, solution (r) and solution (s) were added simultaneously over a period of 15 minutes. After a ten-minute lapse, solution (t) and solution (u) were added simultaneously over a period of 25 minutes. After a five-minute lapse from the conclusion of the simultaneous addition, the temperature of the reaction system was lowered, and desalting was carried out using a flocculation method. Water and gelatin were further added to the reaction product, and the pH thereof was adjusted to 6.2. Thus, monodispersed cubic silver chlorobromide emulsion (9) having a mean grain size of 0.48 μm, a variation coefficient of 0.08, and a bromide content of 80 mole% was prepared.

This emulsion was subjected to optimal chemical sensitization by adding sodium thiosulfate thereto.

In the same manner as described above, except for altering, in solutions (γ) and (S), the amounts of the ingredients used, the preparation temperature and the preparation time, monodispersed cubic silver chlorobromide emulsions (10) to (14) which had the same mean grain size of 0.48 μm, the same variation coefficient of 0.08, and different bromide contents, that is, 77 mole%, 75 mole%, 70 mole%, 67 mole% and 65 mole%, respectively, and other monodispersed cubic silver chlorobromide emulsions (15) to (20) which had the same mean grain size of 0.35 μm, the same variation coefficient of 0.07, and different bromide contents, that is, 80 mole%, 83 mole%, 85 mole%, 70 mole%, 73 mole% and 75 mole%, respectively, were prepared.

In the same manner as emulsions (9) and (12), except for changing the quantity of NaCl in solution (o) to 10.0 g and taking 10 minutes to fulfill the simultaneous addition of solution (r) and solution (s), emulsion (21) and emulsion (22) which had the same mean grain size of 0.42 μm, the same variation coefficient of 0.16, but different bromide contents, that is, 80 mole% and 70 mole%, respectively, were prepared.

In addition, emulsion (23) was prepared in the following manner.

| | |
|---|---|
| Solution (v) | |
| Water | 1,000 ml |
| NaCl | 5.5 g |
| Gelatin | 25 g |
| Solution (w) | |
| Sulfuric Acid (1N) | 20 ml |
| Solution (x) | |
| Silver Halide Solvent represented by the following formula (1% aq. soln.) | 2 ml |

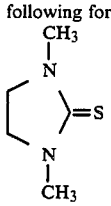

| | |
|---|---|
| Solution (y) | |
| NaCl | 2.15 g |
| Water to make | 140 ml |
| Solution (z) | |
| $AgNO_3$ | 6.25 g |
| Water to make | 140 ml |
| Solution (aa) | |
| KBr | 70.10 g |
| NaCl | 8.17 g |
| $K_2IrCl_6$ (0.001%) | 0.7 ml |
| Water to make | 320 ml |
| Solution (bb) | |
| $AgNO_3$ | 118.75 g |
| Water to make | 320 ml |

Solution (v) was heated to 54° C., and thereto were added solution (w) and solution (x). Then, solution (y) and solution (z) were added simultaneously for 4 minutes. After a five-minute lapse, 16% of solution (aa) and solution (bb) were added simultaneously for 30 seconds, and the remaining 84% of these solutions were added simultaneously over a period of 20 minutes. After a five-minute lapse from the conclusion of the simultaneous addition, the temperature of the reaction system was lowered, and desalting was carried out. Water and gelatin were further added to the reaction product, and the pH of the resulting dispersion was adjusted to 6.2. Thus, monodispersed cubic silver chlorobromide emulsion (23) having a mean grain size of 0.43 μm, a variation coefficient of 0.17, and a bromide content of 80 mole % was prepared. Emulsion (23) was examined for the D-value defined by relationship (I) of the present invention, and it was 10.5.

On the other hand, the D-values of emulsions (1) to (7) were less than 1.0.

In the same manner as emulsion (23), except for changing the amounts of the ingredients, the preparation temperature and the addition times, emulsion (24) which had a mean grain size of 0.42 μm, a variation coefficient of 0.17, and a bromide content of 70 mole% was prepared. The D-value of emulsion (24) was 12.0.

On the other hand, the D-values of emulsions (9) to (22) were less than 1.0.

In producing samples No. 1 to No. 5, one or more of emulsion (1) to (8) was employed as the emulsion of the 1st layer (blue-sensitive layer), one or more of emulsion (9) to (11), (15) to (17), (21) or (23) was employed as that of the 3rd layer (green-sensitive layer), and one or more of emulsion (12) to (14), (18) to (20), (22) or (24) was employed as that of the 5th layer (red-sensitive layer), and thereto were added their respective spectral sensitizing dyes. The blending combinations of these emulsions are shown in Table 4.

TABLE 4

| | Blue-sensitive Layer Emulsion | | | | | Green-sensitive Layer Emulsion | | |
|---|---|---|---|---|---|---|---|---|
| Sample | Emulsion | Blending Ratio (by weight) | Mean Grain Size (μm) | Variation Coefficient | D-value | Emulsion | Blending Ratio (by weight) | Mean Grain Size (μm) |
| 1 | (7) | — | 0.90 | 0.15 | 0.4 | (21) | — | 0.42 |
| 2 | (1)/(4) | 5/5 | 0.91 | 0.14 | 0.5 | (9)/(15) | 5/5 | 0.42 |
| 3 | (8) | — | 0.90 | 0.17 | 9.5 | (23) | — | 0.43 |
| 4 | (2)/(5) | 5/5 | 0.89 | 0.15 | 5.5 | (10)/(16) | 5/5 | 0.42 |
| 5 | (5)/(6) | 5/5 | 0.90 | 0.14 | 9.7 | (11)/(17) | 5/5 | 0.43 |

| | Green-sensitive Layer Emulsion | | Red-sensitive Layer Emulsion | | | | | |
|---|---|---|---|---|---|---|---|---|
| Sample | Variation Coefficient | D-value | Emulsion | Blending Ratio (by weight) | Mean Grain Size (μm) | Variation Coefficient | D-value | Remarks |
| 1 | 0.16 | 0.6 | (22) | — | 0.42 | 0.16 | 0.4 | Comparison |
| 2 | 0.15 | 0.2 | (12)/(18) | 5/5 | 0.43 | 0.15 | 0.4 | Comparison |
| 3 | 0.17 | 10.5 | (24) | — | 0.42 | 0.17 | 12.0 | Invention |
| 4 | 0.14 | 5.0 | (13)/(19) | 5/5 | 0.42 | 0.15 | 5.8 | Invention |
| 5 | 0.15 | 10.1 | (14)/(20) | 5/5 | 0.43 | 0.15 | 9.9 | Invention |

*When emulsions were blended, the mean grain sizes and the variation coefficients set forth above are values of the blended systems.

Each of samples No. 1 to No. 5 set forth in Table 4 was subjected to gradational exposure for sensitometry through each color filter, blue, green or red one, using a sensitometer (Model FWH, made by Fuji Photo Film Co., Ltd.; Color temperature of the light source: 3,200° K.). Therein, the exposure time was 0.5 second, and the exposure was adjusted to 250 CMS.

Each of the optically exposed photographic materials was subjected to photographic processing including the following steps.

The evaluation of the photographic properties was made with regard to two items, sensitivity and gradation. The sensitivity was expressed in terms of a relative value of a reciprocal of an exposure required for producing a density of the minimum density plus 0.5. The condition of the progress in development of each photographic material was viewed taking the sensitivity achieved by the 3.5 minutes' processing as 100. The gradation was expressed in terms of a developed color density corresponding to the exposure expressed in a logarithmic scale which was increased by 0.4, compared with the logarithm of the exposure (log E) at the standard point of the sensitivity.

The results obtained are shown in Table 5.

| Processing Step | Temperature (°C.) | Time (min.) |
|---|---|---|
| Color Development | 33 | 2.5, 3.5, or 4.5 |
| Bleach-Fixation | 33 | 1.5 |
| Washing | 24 to 34 | 3 |
| Drying | 80 | 1 |

The processing solutions used had the following compositions, respectively.

| | |
|---|---|
| Color Developing Solution: | |
| Water | 800 ml |
| Diethylenetriaminepentaacetic Acid | 3.0 g |
| Benzyl Alcohol | 15 ml |
| Diethylene glycol | 10 ml |
| Sodium Sulfite | 2.0 g |
| Potassium Bromide | 0.5 g |
| Potassium Carbonate | 30.0 g |
| N—Ethyl-N—(β-methanesulfonamidoethyl)-3-methyl-4-aminoaniline Sulfate | 5.0 g |
| Hydroxylamine Sulfate | 4.0 g |
| Brightening Agent (4,4'-distilbenze type) | 1.0 g |
| Water to make | 1,000 ml |
| pH (25° C.) adjusted to | 10.10 |
| Bleach-Fix Bath: | |
| Water | 400 ml |
| Ammonium Thiosulfate (70% Soln) | 150 ml |
| Sodium Sulfite | 18 g |
| Ammonium Ethylenediaminetetraacetato-ferrate(III) | 55 g |
| Disodium Ethylenediaminetetraacetate | 5 g |
| Water to make | 1,000 ml |
| pH (25° C.) adjusted to | 6.70 |

EXAMPLE 2

In a manner analogous to Example 1, the effectiveness of the present invention was confirmed in the experiments described below, wherein emulsions having an average bromide content of 10 mole% were used in the corresponding emulsion layers prescribed in Example 1.

The preparation of the silver chlorobromide emulsions employed in this example was illustrated below.

A silver chlorobromide emulsion used for the blue-sensitive layer was prepared in the following manner.

| | |
|---|---|
| Solution (cc) | |
| Water | 1,000 ml |
| NaCl | 5.5 g |
| Gelatin | 32 g |
| Solution (dd) | |
| Sulfuric Acid (1 N) | 20 ml |
| Solution (ee) | |
| Silver Halide Solvent (5% soln.) of formula $HOCH_2CH_2SCH_2CH_2SCH_2CH_2OH$ | 1.7 ml |
| Solution (ff) | |
| KBr | 4.37 g |
| NaCl | 6.45 g |
| Water to make | 130 ml |
| Solution (gg) | |
| $AgNO_3$ | 25 g |
| $NH_4NO_3$ (50% soln.) | 0.5 ml |
| Water to make | 130 ml |
| Solution (hh) | |
| KBr | 4.38 g |
| NaCl | 32.33 g |
| $K_2IrCl_6$ (0.001% soln.) | 0.7 ml |
| Water to make | 285 ml |
| Solution (ii) | |
| $AgNO_3$ | 100 g |
| $NH_4NO_3$ (50% soln.) | 2 ml |
| Water to make | 285 ml |

Solution (cc) was heated to 76° C., and thereto were added solution (dd) and solution (ee). Then, solution (ff) and solution (gg) were added simultaneously over a period of 60 minutes. After a ten-minute lapse, solution (hh) and solution (ii) were added simultaneously over a period of 25 minutes. After a five-minute lapse from the conclusion of the simultaneous addition, the temperature of the reaction system was lowered, and desalting was carried out. Water and a dispersed gelatin were further added to the reaction product, and the pH thereof was adjusted to 6.2. Thus, a monodispersed cibuc silver chlorobromide emulsion having a mean

TABLE 5

| | | 2'30" | | 3'30" | | 4'30" | | |
|---|---|---|---|---|---|---|---|---|
| Sample | Layer | Relative Sensitivity | Gradient | Relative Sensitivity | Gradient | Relative Sensitivity | Gradient | Remarks |
| 1 | B | 79 | 1.50 | 100 | 1.56 | 116 | 1.58 | Comparison |
| | G | 87 | 1.64 | 100 | 1.66 | 109 | 1.67 | |
| | R | 88 | 1.86 | 100 | 1.88 | 110 | 1.89 | |
| 2 | B | 80 | 1.50 | 100 | 1.57 | 115 | 1.58 | Comparison |
| | G | 87 | 1.63 | 100 | 1.65 | 110 | 1.66 | |
| | R | 89 | 1.84 | 100 | 1.86 | 109 | 1.87 | |
| 3 | B | 94 | 1.54 | 100 | 1.56 | 105 | 1.57 | Inventon |
| | G | 95 | 1.63 | 100 | 1.64 | 102 | 1.64 | |
| | R | 96 | 1.85 | 100 | 1.86 | 103 | 1.86 | |
| 4 | B | 90 | 1.54 | 100 | 1.55 | 108 | 1.55 | Invention |
| | G | 92 | 1.64 | 100 | 1.65 | 105 | 1.66 | |
| | R | 93 | 1.87 | 100 | 1.88 | 105 | 1.88 | |
| 5 | B | 93 | 1.56 | 100 | 1.57 | 105 | 1.57 | Invention |
| | G | 96 | 1.64 | 100 | 1.65 | 102 | 1.65 | |
| | R | 96 | 1.87 | 100 | 1.87 | 103 | 1.87 | |

As can be seen from the data set forth in Table 5, the samples having D-values within the limits of the present invention were superior during development, that is to say, they showed only slight variations in their sensitivities and gradations upon changes in the development time.

grain size of 1.01 μm and a variation coefficient (defined as the value obtained by dividing the standard deviation of the size distribution (S) by the mean grains size (γ), (S/γ)) of 0.09 was prepared. Then, the emulsion was subjected to gold and sulfur sensitizations by adding a chloroauric acid in an amount of $4.0\times10^{-5}$ mole per mole of silver, and sodium thiosulfate in an amount to achieve optimal chemical sensitization. The thus obtained emulsion was named emulsion (25).

Emulsions (26) to (30) were prepared in the same manner as described above, except the compositions of solutions (ff) and (hh), and the addition temperature were altered to those shown in Table 6, respectively.

TABLE 6

| Emulsion | NaCl in Solution (ff) (g) | KBr in Solution (ff) (g) | NaCl in Solution (hh) (g) | KBr in Solution (hh) (g) | Total Br Content (mol %) | Surface Br Content (mol %) | Addition Temperature (°C.) | Main Grain Size (μm) | Variation Coefficient |
|---|---|---|---|---|---|---|---|---|---|
| (25) | 6.45 | 4.37 | 32.33 | 4.38 | 10 | 6.3 | 76 | 1.01 | 0.09 |
| (26) | 7.74 | 1.75 | 32.33 | 4.38 | 7 | 6.3 | 76 | 1.01 | 0.08 |
| (27) | 8.60 | 0 | 32.33 | 4.38 | 5 | 6.3 | 76 | 1.03 | 0.08 |
| (28) | 6.45 | 4.37 | 32.33 | 4.38 | 10 | 6.3 | 71 | 0.80 | 0.07 |
| (29) | 5.16 | 7.00 | 32.33 | 4.38 | 13 | 6.3 | 71 | 0.81 | 0.08 |
| (30) | 4.30 | 8.75 | 32.33 | 4.38 | 15 | 6.3 | 71 | 0.81 | 0.07 |

In the same manner as emulsion (25), except for altering the quantity of NaCl in solution (cc) to 26.5 g and altering the addition time of solution (ff) and (gg) to 15 min., emulsion (31) having a mean grain size of 0.91 μm, a variation coefficient of 0.15 and a bromide content of 10 mole% was prepared.

Further, emulsion (32) was prepared in the following manner.

| | |
|---|---|
| Solution (jj) | |
| Water | 1,000 ml |
| NaCl | 17.5 g |
| Gelatin | 25.0 g |
| Solution (kk) | |
| Sulfuric Acid (1 N) | 20.0 ml |
| Solution (ll) | |
| Silver Halide Solvent (5% aq. soln.) of Formula $HOC_2H_4SC_2H_4SC_2H_4OH$ | 1.7 ml |
| Solution (mm) | |
| NaCl | 17.2 g |
| Water to make | 400.0 ml |
| Solution (nn) | |
| $AgNO_3$ | 50.0 g |
| Water to make | 400.0 ml |
| Solution (oo) | |
| NaCl | 21.50 g |
| KBr | 8.75 g |
| $K_2IrCl_6$ (0.001% soln.) | 1.0 ml |
| Water to make | 250.0 ml |
| Solution (pp) | |
| $AgNO_3$ | 75.0 g |
| Water to make | 250.0 ml |

Solution (jj) was heated to 75° C., and thereto were added solution (kk) and the solution (ll). Then, the solution (mm) and solution (nn) were added simultaneously under virgorous stirring over a period of 40 minutes. After a ten-minute lapse, the temperature of the reaction mixture was lowered to 71° C., and thereto were added simultaneously 17% of solution (oo) and solution (pp) for 30 sec., and the remaining 83% thereof over a period of 10 minutes. After a five-minute lapse from the conclusion of the simultaneous addition, the temperature of the reaction system was lowered, and desalting was carried out using a flocculation method. Water and gelatin were further added to the reaction product, the temperature thereof was raised to 58° C., and the pH was adjusted to 6.2. Thus, a silver chlorobromide emulsion having a mean grain size of 0.92 μm, a variation coefficient of 0.17 and a bromide content of 10 mole% was prepared, and then subjected to gold and sulfur sensitizations in the same manner as emulsion (25). The thus obtained emulsion was named emulsion (32). This emulsion was examined for the D-value defined by the relationship (I) of the present invention according to the method described in this specification. The D-value of emulsion (32) was 9.2.

Silver chlorobromide emulsion (33) for the green-sensitive layer was prepared in the following manner.

| | |
|---|---|
| Solution (qq) | |
| Water | 1,000 ml |
| NaCl | 5.5 g |
| Gelatin | 32 g |
| Solution (rr) | |
| Sulfuric acid (1 N) | 24 ml |
| Solution (ss) | |
| Same Silver Halide Solvent as contained in Solution (ee)(1% soln.) | 3 ml |
| Solution (tt) | |
| KBr | 5.60 g |
| NaCl | 8.26 g |
| Water to make | 220 ml |
| Solution (uu) | |
| $AgNO_3$ | 32 g |
| Water to make | 200 m |
| Solution (vv) | |
| KBr | 5.60 g |
| NaCl | 41.26 g |
| $K_2IrCl_6$(0.001% soln.) | 4.5 ml |
| Water to make | 600 ml |
| Solution (ww) | |
| $AgNO_3$ | 128 g |
| Water to make | 600 ml |

Solution (qq) was heated to 56° C., and thereto were added solution (rr) and solution (ss). Then, solution (tt) and solution (uu) were added simultaneously over a period of 10 minutes. After a ten-minute lapse, solution (vv) and solution (ww) were added simultaneously over a period of 8 minutes. After a five-minute lapse from the conclusion of the simultaneous addition, the temperature of the reaction system was lowered, and desalting was carried out. Water and a dispersed gelatin were further added to the reaction product, and the pH thereof was adjusted to 6.2. Thus, a monodispersed cubic silver chlorobromide emulsion having a mean grain size of 0.45 μm and a variation coefficient of 0.08 was prepared.

In the same manner as described above, except for altering the compositions of solutions (tt) and (vv) and the addition temperatures to those set forth in Table 7, monodispersed cubic silver chlorobromide emulsions (34) to (44), which each was to be used for the green-sensitive or the red-sensitive layer, were prepared. Then, these emulsions were subjected to gold and sulfur sensitizations by adding a chloroauric acid in an amount of $1.0\times10^{-4}$ mole per mole of silver, and sodium thiosulfate in an amount to achieve optimal chemical sensitization.

TABLE 7

| Emulsion | NaCl in Solution (tt) (g) | KBr in Solution (tt) (g) | NaCl in Solution (vv) (g) | KBr in Solution (vv) (g) | Total Br Content (mol %) | Surface Br Content (mol %) | Addition Temperature (°C.) | Main Grain Size (μm) | Variation Coefficient |
|---|---|---|---|---|---|---|---|---|---|
| (33) | 8.26 | 5.60 | 41.26 | 5.6 | 10 | 6.3 | 56 | 0.45 | 0.08 |
| (34) | 9.91 | 2.24 | 41.26 | 5.6 | 7 | 6.3 | 56 | 0.45 | 0.08 |
| (35) | 11.01 | 0 | 41.26 | 5.6 | 5 | 6.3 | 56 | 0.45 | 0.07 |
| (36) | 8.26 | 5.60 | 41.26 | 5.6 | 10 | 6.3 | 46 | 0.35 | 0.08 |
| (37) | 6.60 | 9.00 | 41.26 | 5.6 | 13 | 6.3 | 46 | 0.35 | 0.08 |
| (38) | 5.50 | 11.20 | 41.26 | 5.6 | 15 | 6.3 | 46 | 0.35 | 0.08 |
| (39) | 8.26 | 5.60 | 41.26 | 5.6 | 10 | 6.3 | 61 | 0.51 | 0.08 |
| (40) | 9.91 | 2.24 | 41.26 | 5.6 | 7 | 6.3 | 61 | 0.51 | 0.08 |
| (41) | 11.01 | 0 | 41.26 | 5.6 | 5 | 6.3 | 61 | 0.51 | 0.07 |
| (42) | 8.26 | 5.60 | 41.26 | 5.6 | 10 | 6.3 | 51 | 0.40 | 0.08 |
| (43) | 6.60 | 9.00 | 41.26 | 5.6 | 13 | 6.3 | 51 | 0.40 | 0.08 |
| (44) | 5.50 | 11.20 | 41.26 | 5.6 | 15 | 6.3 | 51 | 0.40 | 0.08 |

In the same amount as emulsions (33) and (39), except for altering the amount of NaCl in solution (qq) to 10.0 g and taking 10 minutes to fulfill the simultaneous addition of solution (tt) and (uu), emulsions (45) and (46) which had different mean grain sizes, 0.41 μm and 0.46 μm, respectively, but the same variation coefficient of 0.15 and the same bromide content of 10 mole% were prepared.

Furthermore, the emulsion (47) was prepared in the following manner.

| | |
|---|---|
| Solution (xx) | |
| Water | 1,000 ml |
| NaCl | 5.5 g |
| Gelatin | 25.0 g |
| Solution (yy) | |
| Sulfuric Acid (1 N) | 20.0 ml |
| Solution (zz) | |
| Silver Halide Solvent of (5% aq. soln.) of Formula, $HOC_2H_4SC_2H_4SC_2H_4OH$ | 1.7 ml |
| Solution (aaa) | |
| NaCl | 22.02 g |
| Water to make | 140.0 ml |
| Solution (bbb) | |
| $AgNO_3$ | 64.0 g |
| Water to make | 140.0 ml |
| Solution (ccc) | |
| KBr | 11.20 g |
| NaCl | 27.52 g |
| $K_2IrCl_6$ (0.001%) | 0.7 ml |
| Water to make | 320.0 ml |
| Solution (ddd) | |
| $AgNO_3$ | 96.0 g |
| Water to make | 320.0 ml |

Solution (xx) was heated to 54° C., and thereto were added solution (yy) and solution (zz). Then, the solution (aaa) and solution (bbb) were added simultaneously over a period of 40 minutes. After a five-minute lapse, 16% of solution (ccc) and solution (ddd) were added simultaneously for 30 seconds, and the remaining 84% of these solutions were added simultaneously over a period of 20 minutes. After a five-minute lapse from the conclusion of the simultaneous addition, the temperature of the reaction system was lowered, and desalting was carried out. Water and a dispersed gelatin were further added to the reaction product, and the pH thereof was adjusted to 6.2. Thus, emulsion (47) having a mean grain size of 0.40 μm, a variation coefficient of 0.17 and a bromide content of 10 mole% was prepared. Emulsion (47) was examined for the D-value defined by the relationship (I) of the present invention, and it was 11.8.

In the same manner as emulsion (47), except for altering the amounts of the ingredients used, the addition temperature and the addition times, emulsion (48) having a mean grain size of 0.45 μm, a variation coefficient of 0.16 and a bromide content of 70 mole% was prepared. The D-value of emulsion (48) was 10.5.

Emulsions (47) and (48) were subjected to the same gold and sulfur sensitizations as emulsion (33).

The D-values of the emulsions described above, other than emulsions (32), (47) and (48), were less than 1.0.

In producing samples No. 6 to No. 10, one or more of emulsion (25) to (32) was employed as the emulsion of the 1st layer (blue-sensitive layer), one or more of emulsion (33) to (38), (45) or (47) was employed as that of the 3rd layer (green-sensitive layer), and one or more of the emulsion (39) to (44), (46) or (48) was employed as that of the 5th layer (red-sensitive layer), and thereto were added their respective spectral sensitizing agents (i), (ii) and (iii). The blending combinations of these emulsions are shown in Table 8.

(i) Spectral Sensitizing Agent for Blue-sensitive Layer

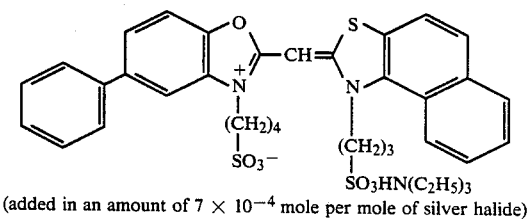

(added in an amount of $7\times10^{-4}$ mole per mole of silver halide)

(ii) Spectral Sensitizing Agent for Green-sensitive Layer

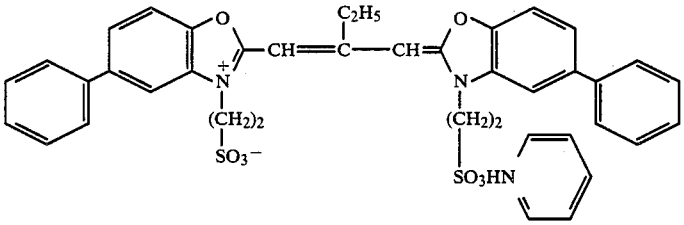

(added in an amount of $7 \times 10^{-4}$ mole per mole of silver halide)

(iii) Spectral Sensitizing Agent for Red-sensitive Layer

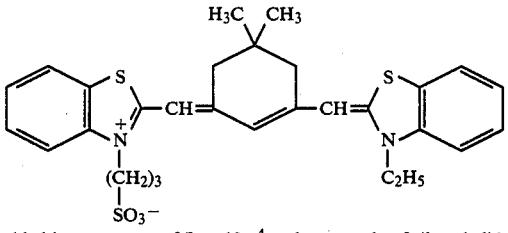

(added in an amount of $7 \times 10^{-4}$ mole per mole of silver halide)

The processing solutions used had the following compositions, respectively.

| Color Developing Solution: | |
|---|---|
| Water | 800 ml |
| Diethylenetriaminepentaacetic Acid | 1.0 g |
| Sodium Sulfite | 0.2 g |
| N,N—Diethylhydroxylamine | 4.2 g |
| Potassium Bromide | 0.01 g |
| Sodium Chloride | 1.5 g |
| Triethanolamine | 8.0 g |
| Potassium Carbonate | 30 g |
| N—Ethyl-N—(β-methanesulfonamidoethyl)-3-methyl-4-aminoaniline Sulfate | 4.5 g |
| Brightening Agent of 4,4'-Distilbenze Type (Whitex 4, produced by Sumitomo Chemical Co., Ltd.) | 2.0 g |
| Water to make | 1,000 ml |
| pH adjusted with KOH to | 10.05 |
| Bleach-Fix Bath: | |
| EDTAFe(III)$NH_4$.2$H_2O$ | 60 g |
| EDTA2Na.2$H_2O$ | 4.0 g |
| Ammonium Thiosulfate (70% soln.) | 120 ml |
| Sodium Sulfite | 16 g |
| Acetoaldehyde/Sulfite Adduct | 10 g |
| Gracial Acetic Acid | 7 g |
| Water to make | 1,000 ml |
| pH adjusted to | 5.50 |
| Rinsing Bath: | |
| EDTA2Na.2$H_2O$ | 4.0 g |
| Water to make | 1,000 ml |
| pH adjusted to | 7.00 |

TABLE 8

| | Blue-sensitive Layer Emulsion | | | | | Green-sensitive Layer Emulsion | | |
|---|---|---|---|---|---|---|---|---|
| Sample | Emulsion | Blending Ratio (by weight) | Mean Grain Size (μm) | Variation Coefficient | D-value | Emulsion | Blending Ratio (by weight) | Mean Grain Size (μm) |
| 6 | (31) | — | 0.91 | 0.15 | 0.2 | (45) | — | 0.41 |
| 7 | (25)/(28) | 5/5 | 0.90 | 0.14 | 0.1 | (33)/(36) | 5/5 | 0.41 |
| 8 | (32) | — | 0.92 | 0.17 | 9.2 | (47) | — | 0.40 |
| 9 | (26)/(29) | 5/5 | 0.91 | 0.15 | 5.2 | (34)/(37) | 5/5 | 0.41 |
| 10 | (27)/(30) | 5/5 | 0.91 | 0.14 | 10.2 | (35)/(38) | 5/5 | 0.40 |

| | Green-sensitive Layer Emulsion | | Red-sensitive Layer Emulsion | | | | | |
|---|---|---|---|---|---|---|---|---|
| Sample | Variation Coefficient | D-value | Emulsion | Blending Ratio (by weight) | Mean Grain Size (μm) | Variation Coefficient | D-value | Remarks |
| 6 | 0.15 | 0.0 | (46) | — | 0.46 | 0.15 | 0.4 | Comparison |
| 7 | 0.15 | 0.1 | (39)/(42) | 5/5 | 0.45 | 0.16 | 0.3 | Comparison |
| 8 | 0.17 | 11.8 | (48) | — | 0.45 | 0.16 | 10.5 | Invention |
| 9 | 0.14 | 5.6 | (40)/(43) | 5/5 | 0.46 | 0.15 | 5.3 | Invention |
| 10 | 0.15 | 9.4 | (41)/(44) | 5/5 | 0.46 | 0.15 | 9.8 | Invention |

The samples No. 6 to No. 10 described in Table 8 were exposed in the same manner as in Example 1, and subjected to the photographic processing including the following steps. Their photographic properties were evaluated using the same method as in Example 1.

The results obtained are shown in Table 9.

| Processing Step | Temperature (°C.) | Time (sec.) |
|---|---|---|
| Color Development | 35 | 30, 45, or 60 |
| Bleach-Fixation | 35 | 45 |
| Rinsing | 35 | 90 |

TABLE 9

| Sample | Layer | Development Time 30" Relative Sensitivity | Development Time 30" Gradient | Development Time 45" Relative Sensitivity | Development Time 45" Gradient | Development Time 60" Relative Sensitivity | Development Time 60" Gradient | Remarks |
|---|---|---|---|---|---|---|---|---|
| 6 | B | 75 | 1.50 | 100 | 1.58 | 117 | 1.60 | Comparison |
| | G | 86 | 1.67 | 100 | 1.70 | 109 | 1.71 | |
| | R | 87 | 1.84 | 100 | 1.86 | 109 | 1.87 | |
| 7 | B | 76 | 1.50 | 100 | 1.59 | 116 | 1.61 | Comparison |
| | G | 86 | 1.67 | 100 | 1.69 | 110 | 1.70 | |
| | R | 88 | 1.85 | 100 | 1.87 | 110 | 1.88 | |
| 8 | B | 95 | 1.57 | 100 | 1.57 | 104 | 1.57 | Invention |
| | G | 96 | 1.66 | 100 | 1.67 | 102 | 1.67 | |
| | R | 97 | 1.85 | 100 | 1.85 | 101 | 1.85 | |
| 9 | B | 91 | 1.56 | 100 | 1.58 | 107 | 1.58 | Invention |
| | G | 93 | 1.67 | 100 | 1.68 | 104 | 1.68 | |
| | R | 94 | 1.86 | 100 | 1.87 | 104 | 1.87 | |
| 10 | B | 95 | 1.58 | 100 | 1.59 | 103 | 1.59 | Invention |
| | G | 97 | 1.67 | 100 | 1.68 | 101 | 1.68 | |
| | R | 97 | 1.86 | 100 | 1.86 | 102 | 1.86 | |

As can be seen from the data set forth in Table 9, the samples produced in accordance with the present invention showed only slight variations in their sensitivities and gradations due to changes in the development time, that is to say, they were very excellent in developability.

While the invention has been described in detail and with reference to specific embodiments thereof, it will be apparent to one skilled in the art that various changes and modifications can be made therein without departing from the spirit and scope thereof.

What is claimed is:

1. A negative-working photographic light-sensitive material comprising a support having thereon at least one silver halide emulsion layer, wherein said silver halide emulsion layer comprises a silver chlorobromide emulsion which is substantially free of iodide and has a chloride content which statisfies the following relationship (I) between the mean mole% of silver chloride in grain group (A), in which the grains have sizes not less than the median size in the grain size distribution of said silver halide emulsion, and the mean mole% of silver chloride in grain group (B) in which the grains have sizes less than the median size:

Relationship (I): $3 \leqq$ [Mean mole% of silver chloride in grain group (A)] − [Mean mole% of silver chloride in grain group (B)] $\leqq 50$.

2. The negative-working photographic light-sensitive material of claim 1, wherein the difference between the mean mole% of silver chloride in grain group (A) and that in grain group (B) is about 5–30.

3. The negative-working photographic light-sensitive material of claim 1, wherein the grains have a mean grain size of 0.1–2 μm.

4. The negative-working photographic light-sensitive material of claim 3, wherein the grains have a mean grain size of 0.2–1.3 μm.

5. The negative-working photographic light-sensitive material of claim 1, wherein said silver halide emulsion layer contains 1.0 mole% or less of iodide.

6. The negative-working photographic light-sensitive material of claim 5, wherein said silver halide emulsion layer contains 0.5 mole% or less of iodide.

7. The negative-working photographic light-sensitive material of claim 6, wherein said silver halide emulsion layer contains 0 mole% of iodide.

8. The negative-working photographic light-sensitive material of claim 1, wherein said silver halide emulsion has at least two grain size distributions.

9. The negative-working photographic light-sensitive material of claim 1 wherein said silver halide emulsion is a monodispersed emulsion.

10. The negative-working photographic light-sensitive material of claim 9, wherein said monodispersed emulsion has a variation coefficient of not more than 0.2.

11. The negative-working photographic light-sensitive material of claim 10, wherein said monodispersed emulsion has a variation coefficient of not more than 0.15.

12. The negative-working photographic light-sensitive material of claim 11, wherein said monodispersed emulsion has a variation coefficient of not more than 0.10.

13. The negative-working photographic light-sensitive material of claim 1, wherein the crystal form of the grains contained in said silver halide emulsion is a cube or a tetradecahedron.

14. The negative-working photographic light-sensitive material of claim 1, wherein said silver halide emulsion contains a pyrazotriazole type coupler.

15. The negative-working photographic light-sensitive material of claim 14, wherein said silver halide emulsion contains a pyrazolo[1,5-b][1,2,4]triazole or a imidazo[1,2-b]pyrazole.

16. The negative-working photographic light-sensitive material of claim 1, wherein said silver halide emulsion is spectrally sensitized by a sensitizing dye.

17. The negative-working photographic light-sensitive material of claim 16, wherein the sensitizing dye is added in the step selected from (1) during the formation of the silver halide grains, (2) during the physical ripening, or at the stage after physical ripening to before chmical sensitization, or (3) during the chemical sensitization, or at the stage after chemical sensitization to before coating.

18. The negative-working photographic light-sensitive material of claim 17, wherein the sensitizing dye is added during the physical ripening, or at the stage after physical ripening to before chemical sensitization.

* * * * *